United States Patent [19]

Kondo et al.

[11] Patent Number: 4,681,993

[45] Date of Patent: Jul. 21, 1987

[54] SPRING OPERATING MECHANISM FOR AN ELECTRICAL SWITCH

[75] Inventors: Tadashi Kondo; Kiyoshi Yabe, both of Amagasaki, Japan

[73] Assignee: Mitsubishi Denki Kabushiki Kaisha, Japan

[21] Appl. No.: 843,198

[22] Filed: Mar. 24, 1986

[30] Foreign Application Priority Data

Mar. 25, 1985 [JP] Japan ..... 60-44202[U]

[51] Int. Cl.[4] ..... H01H 3/02

[52] U.S. Cl. ..... 200/153 SC; 74/569

[58] Field of Search ..... 200/17 R, 153 N, 153 SC, 200/153 V; 74/569

[56] References Cited

U.S. PATENT DOCUMENTS 4,524,637 6/1985 Yoshizumi ..... 200/153 SC X

*Primary Examiner*—A. D. Pellinen

*Assistant Examiner*—Morris Ginsburg

*Attorney, Agent, or Firm*—Leydig, Voit & Mayer

[57] ABSTRACT

An operating mechanism for an electrical switch comprises a drive mechanism; a drive lever having an engaging surface and connected to the drive mechanism for rotation about an axis; an actuating lever rotatable about the axis independently of the drive lever and having a first and a second engagement surface, the first engagement surface engageable with the engaging surface of the drive lever and the actuating lever being rotated when the engaging surface of the drive lever engages and pushes the first engagement surface of the actuating lever; an energy storing means connected in an over-center relationship to the actuating lever for selectively storing and discharging spring energy for opening and closing the the electrical switch in accordance with the rotational movement of the actuating lever; a driven lever rotatable about the axis independently of the drive lever and the actuating lever and having an engagement surface engageable with the second engagement surface of the actuating lever, the driven lever being connected to a movable contact of the electrical switch for opening and closing the contacts in accordance with the rotational movement of the driven lever, and the driven lever being rotatable when the actuating lever rotates and the second engagement surface of the actuating lever pushes the engagement surface of the driven lever. A single common shaft is used for mounting thereon all of the drive lever, the actuating lever, and the driven lever.

4 Claims, 4 Drawing Figures

SPRING OPERATING MECHANISM FOR AN ELECTRICAL SWITCH

BACKGROUND OF THE INVENTION

This invention relates to a spring operating mechanism for an electrical switch in which the energy stored in a spring mechanism causes an electrical power switching device to open or close.

FIG. 1 is a perspective schematic diagram showing a conventional spring operating mechanism as disclosed in Japanese Patent Laid-Open No. 59-163720 laid-open in March, 1984, and FIG. 2 is a partial detailed view of the same mechanism as seen in the direction of arrow A in FIG. 1.

The illustrated conventional operating mechanism comprises a drive mechanism 30 including a reversible electric motor 1, a speed reduction device 3 having an input shaft 3*a* and output shaft 3*b*, and a chain 2 for transmitting the rotation of the electric motor 1 to the input shaft 3*a* of the speed reduction device 3. On the output shaft 3*b* of the speed reduction device 3, a drive lever 4 is secured so that the drive lever 4 is operationally connected to the drive mechanism 30 for rotation about an axis of the output shaft 3*b*. The drive lever 4 has first and second engaging surfaces 31 and 32 which are circumferentially spaced.

The operating mechanism further comprises an actuating lever 5 rotatable about an axis of the pivot pin 11 which is in alignment with the output shaft 3*b*. Since the pivot pin 11 of the lever 5 is separate from the shaft 3*b* and rotatably supported at its opposite ends by bearings 17 and 18, the lever 5 is rotatable independently of the drive lever 4. The actuating lever 5 has a first and a second engagement surface 5*a*, 5*b* which are a pair of projections extending in opposite directions from both sides of the lever 5. When the drive lever 4 is rotated counterclockwise in FIG. 1, the engaging surface 31 of the drive lever 4 engages and pushes the projection 5*a* of the actuating lever 5 to rotate it counterclockwise about the pivot pin 11. When the drive lever 4 is rotated clockwise in FIG. 1, the second engaging surface 32 engages and pushes the projection 5*a* of the actuating lever 5 to rotate the actuating lever 5 clockwise.

The free end of the actuating lever 5 is connected to an energy storing mechanism 9 connected in an over-center relationship for selectively storing and releasing spring energy for opening and closing the electrical switch in accordance with the rotational movement of the actuating lever 5. In the illustrated embodiment, the energy storing mechanism 9 comprises a spring rod 6 pivotally connected at one end to the free end of the actuating lever 5 by a pivot pin 6*a*, and a flange 7 being secured to the rod 6. The other end of the rod 6 is slidably received within a cylinder 8 which has a flange 8*a* at its bottom. A pair of pivot pins 8*b* are attached to the flange 8*a* to pivotably support the bottom end of the spring mechanism 9 by an unillustrated frame. Between the flange 7 on the spring rod 6 and the flange on the cylinder 8, a compression spring 9*a* is disposed.

The positions of the pivot pin 11 for the actuating lever 5 and the pivot pin 8*b* at the bottom of the spring mechanism 9 are fixed and the pin 6*a* connecting the free end of the actuating lever 5 and the upper end of the spring mechanism 9 moves along the circle described by the free end of the actuating lever 5 about the pivot pin 11. The positions of these pins 11, 6*a* and 8*b* are selected so that the direction of the compressive force of the spring 9*a* acting on the actuating lever 5 through the spring rod 6 to rotate the lever 5 is changed when the knee point of the pivot pin 6*a* between the lever 5 and the spring mechanism 9 moves beyond a line "A" extending through the axis of the pin 11 and the axis of the pin 8*b*. In this context, the free end of the actuating lever 5 can be viewed as being connected to an energy storing mechanism 9 in a known over-center relationship.

The operating mechanism further comprises a driven lever 10 secured on a driven shaft 13 rotatably supported by a pair of bearings 19 and 20. The driven lever 10 has a first engaging surface 33 and a second engaging surface 34 which are circumferentially spaced and radially extending surfaces for being engaged by the second projection 5*b* on the actuating lever 5. When the actuating lever 5 is rotated counterclockwise in FIG. 1, the projection 5*b* of the actuating lever 5 engages the second engaging surface 34 of the driven lever 10 pushing the engaging surface 34 down to rotate the driven lever 10 counterclockwise. When the actuating lever 5 is rotated clockwise in FIG. 1, the engaging projection 5*b* engages and pushes the first engaging surface 33 of the driven lever 10 to rotate the driven lever 10 clockwise. The driven shaft 13 is in alignment with and rotatable about an axis aligned with the other rotational axes of the drive lever 4 and the actuating lever 5. Since the driven shaft 13 is independent and separate from other shafts and pins 8*b* and 11, driven lever 10 can rotate relatively independently of the other levers 4 and 5. The driven shaft 13 has also secured thereto a connecting lever 12 which is pivotally connected to one end of an operating rod 14. The other end of the operating rod 14 is connected to a movable contact 15 of the electrical switch for opening and closing the contacts.

Thus, when the actuating lever 5 rotates counterclockwise and the second projection 5*b* of the actuating lever 5 engages and pushes the engagement surface 34 of the driven lever 10, the driven lever 10 is rotated counterclockwise. This counterclockwise rotation of the driven lever 10 is transmitted and converted into a closing movement of the movable contact of the contacts 15 of the electrical switch through the driven shaft 13, the connecting lever 12 and the operating rod 14. When the driven lever 10 is rotated clockwise, the contacts 15 are separated.

Since the conventional spring operating mechanism is constructed as described above, when the drive lever 4 is rotated counterclockwise by the electric motor 1, it engages with the projection 5*a* of the actuating lever 5 to rotate the actuating lever 5 counterclockwise. During this movement, the free end of the actuating lever 5 pushes the upper end of the coil spring 9*a* downward through the spring rod 6 and the upper spring washer 7 to compress the spring 9*a*. During compression, the second projection 5*b* of the actuating lever 5 does not act on the engaging surface of the driven lever 10 due to the lost-motion arrangement between the two levers 5 and 10. When the connecting pin 6*a* of the actuating lever 5 moves right in FIG. 1 beyond the dead point line "A" extending through the axes of the pivot pin 11 and the support pins 8*b* of the flange washer 8*a*, the actuating lever 5 is rapidly rotated counterclockwise by the energy stored in the compressed coil spring 9*a*. Then the second projection 5*b* of the actuating lever 5 abuts the engagement surface of the driven lever 10 to rapidly rotate the driven lever 10 couterclockwise. This counterclockwise rotation of the driven lever 10 causes the counterclockwise rotation of the transmission lever 12 through the driven shaft 13 to cause the contacts 15 to close through the operating rod 14. The opening operation is achieved by rotating the electric motor 1 in the direction opposite to the case of the closing operation, whereby the transmission lever 12 is rotated clockwise to open the contact device 15 of the electrical switch.

Since the conventional spring operating mechanism comprises three separate axially aligned shafts, i.e., the output shaft 3*b*, the pivot shaft 11 and the driven shaft 13, for rotatably supporting independently the drive lever 4, the actuating lever 5 and the driven lever 10, each shaft must be rotatably supported by respective bearings. With this arrangement, not only a large axial space is required, but also a large distance between the drive lever 4, the actuating lever 5 and the driven lever 10 is required due to the axial space needed for installing the bearings. Therefore, the torque acting on the actuating lever 5 is increased, requiring more strength in the lever 5. Also, the number of parts is relatively large, resulting in an increased cost.

SUMMARY OF THE INVENTION

Accordingly, an object of the present invention is to provide an operating mechanism for an electrical switch that is free from the above-mentioned drawbacks.

Another object of the present invention is to provide an operating mechanism for an electrical switch which is more efficient, compact and less expensive than conventional mechanisms.

Still another object of the present invention is to provide an operating mechanism for an electrical switch which is reliable.

With the above objects in view, the present invention provides, in combination with an electrical switch having a movable contact, an operating mechanism comprising a drive mechanism and a drive lever having an engaging surface and which is connected to the drive mechanism for rotation about an axis. The operating mechanism also comprises an actuating lever rotatable about the same axis independently of the drive lever and having a first and a second engagement surface. The first engagement surface can engage the engaging surface of the drive lever and actuating lever is rotated when the engaging surface of the drive lever engages and pushes the first engagement surface of the actuating lever. The operating mechanism also comprises an energy storing mechanism connected in an over-center relationship to the actuating lever for selectively storing and discharging energy for opening and closing the electrical switch in accordance with the rotational movement of the actuating lever. The operating mechanism further comprises a driven lever rotatable about the same axis independently of the drive lever and the actuating lever and which has an engagement surface that can engage the second engagement surface of the actuating layer. The driven lever is connected to the movable contact of the electrical switch for opening and closing the contact in accordance with the rotational movement of the driven lever, and the driven lever is rotatable when the actuating lever rotates and the second engagement surface of the actuating lever pushes the engagement surface of the driven lever. According to the present invention, only a single common shaft is used for mounting thereon the drive lever, the actuating lever and the driven lever.

Since the spring operating mechansim of the present invention utilizes a single shaft for mounting thereon the drive lever, the actuating lever and the driven lever, only two bearings at the opposite ends of the single shaft are needed and the distance between the drive lever, the actuating lever and the driven lever can be greatly decreased as compared to the conventional design and the torque acting on the actuating lever is also significantly decreased, resulting in a smaller actuating lever. Also, since the centers of the drive lever, the actuating lever and the driven lever are mounted on a common shaft, their rotational axes are in precise alignment with each other, and the engagement between the respective levers can be made smooth and efficient, providing higher reliability.

BRIEF DESCRIPTION OF THE DRAWINGS

The present invention will become more readily apparent from the following detailed description of the preferred embodiment of the present invention taken in conjunction with the accompanying drawings, in which.

DETAILED DESCRIPTION OF THE PREFERRED EMBODIMENT

Figure 2:
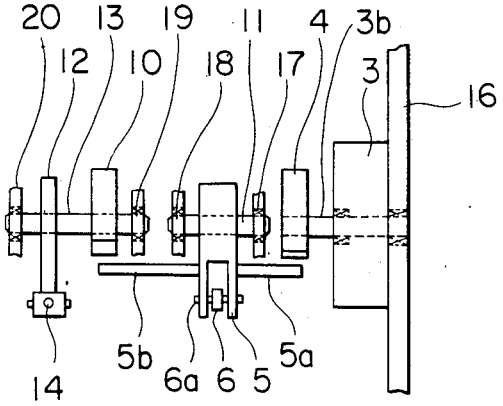
FIG. 2 PRIOR ART
FIG. 2 is a schematic plan view of the operating mechanism as seen in the direction of the arrow A of FIG. 1.
Figure 3:
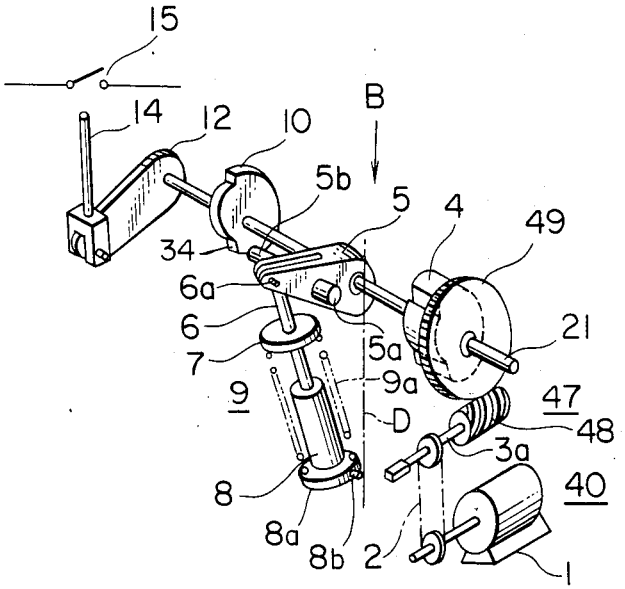
FIG. 3 is a perspective view showing the spring operating mechanism of the present invention.
Figure 4:
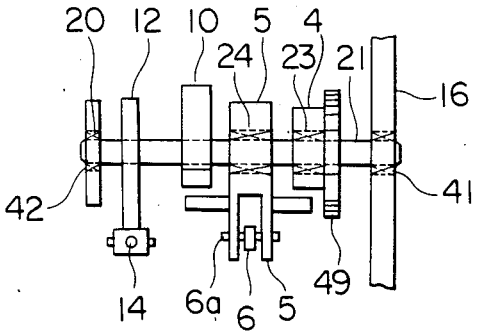
FIG. 4 is a schematic plan view of the operating mechanism as seen in the direction of the arrow B of FIG. 3.

FIGS. 3 and 4 illustrate a preferred embodiment of the present invention wich will now be described. The operating mechanism of the present invention comprises basically the same or similar components as compared to the conventional mechanism shown in FIGS. 1 and 2, so that the description will basically be made in terms of the differences of the arrangement of the operating mechanism of the present invention with respect to the conventional mechanism as described and shown in FIGS. 1 and 2.

Figure 1:
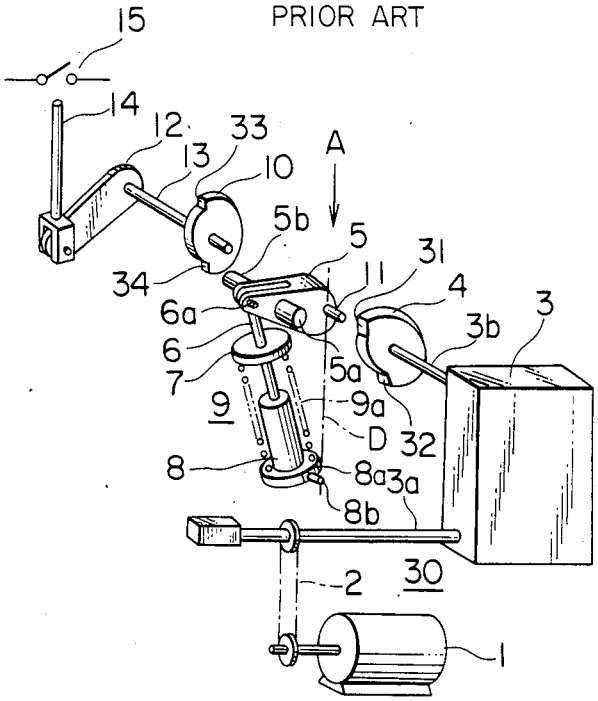
FIG. 1 PRIOR ART
FIG. 1 is a perspective view showing a conventional spring operating device.

By comparing the mechanism of the present invention shown in FIGS. 3 and 4 with the conventional device shown in FIGS. 1 and 2, it is apparent that the operating mechanism of the present invention comprises a single common shaft 21, rather than three separate shafts, for mounting thereon the drive lever 4, the actuating lever 5 and the driven lever 10. The common shaft 21 is rotatably supported between a pair of support plates 16 and 20 by bearings 41 and 42 disposed at opposite ends of the common shaft 21. According to the illustrataed embodiment, the drive lever 4 is rotatably mounted on the rotatable common shaft 21 by means of a bearing 23, and the actuating lever 5 is also rotatably mounted on the rotatable shaft 21 by means of a bearing 24. The driven lever 10 is secured to the common rotatable shaft. Thus, the levers 4 and 5 are rotatable relative to the driven lever 10 and to each other.

It is also seen that a drive mechanism 40 includes a reversible electric motor 1, a speed reduction device 47 having a worm 48 secured on an input shaft 3*a* and a worm wheel 49 secured to the drive lever 4 which is rotatable relative to the common shaft 21, and a chain 2 for transmitting the rotation of the electric motor 1 to the input shaft 3*a* of the speed reducing device 47. In other respects, the structure is the same as the conventional operating mechanism shown in FIGS. 1 and 2.

When the drive lever 4 is rotated on the common shaft 21 counterclockwise by the electric motor 1 through the worm 48 and the worm wheel 49, the drive lever 4 engages with the projection 5*a* of the actuating lever 5 to rotate the actuating lever 5 relative to the common shaft 21 to compress the spring 9*a*. During compression, the second projection 5*b* of the actuating lever 5 does not act on the engaging surface 34 of the driven lever 10 due to the lost-motion arrangement between two levers 5 and 10. As the over-center mechanism reverses counterclockwise the direction of the spring force which rotates the actuating lever 5, the actuating lever 5 is rapidly rotated counterclockwise by the energy stored in the compressed coil spring 9*a*, and the second projection 5*b* of the actuating lever 5 abuts the engagement surface 34 of the driven lever 10 to rapidly rotate the driven lever 10 together with the common shaft 21 counterclockwise. This counterclockwise rotation of the driven lever 10 causes the contacts 15 to close through the transmission lever 12 and the operating rod 14. The opening operation is achieved by rotating the electric motor 1 in the direction opposite to that used in the closing operation, whereby the transmission lever 12 is rotated clockwise to separate the contacts 15 of the electrical switch.

In the above embodiment, the driven lever 10 and the transmission lever 12 are secured to the rotatable common shaft 21, and the drive lever 4 and the actuating lever 5 are rotatably mounted to the rotatable common shaft 21. However, as long as the three levers 4, 5 and 10 are independently rotatable relative to each other, and the levers 10 and 12 rotate together, various modifications or changes may be made. For example, the driven lever 10 and the transmission lever 12 may be made as an integral lever (10, 12) which is rotatable relative to the common shaft 21, and the drive lever 4 may be secured to the common shaft 21 and the actuating lever 5 and the integral lever (10, 12) may be rotatably supported on the common shaft 21. Alternatively, the actuating lever 5 may be secured and the drive lever 4 and the integral lever (10, 12) may be rotatably supported to the common shaft 21, or the drive lever 4, the actuating lever 5 and the integral lever (10, 12) may all be rotatably supported on the common shaft 21.

As has been described, according to the present invention, the output shaft 3*b* of the speed reduction device 3, the support shaft 11 and the driven shaft 13 are made to be an integral single shaft, so that the number of the bearings for rotatably supporting the various levers can be reduced and the operating mechanism can be made compact. Also, since the rotational centers of the drive lever 4, the actuating lever 5 and the driven lever 10 are naturally aligned precisely on a common single axis, the respective levers smoothly engage, so that the efficiency of the spring operating mechanism is significantly increased. Also, since the number of components of the mechanism is significantly reduced, the operating mechanism of the present invention can be manufactured at less expense and relatively easily assembled.

What is claimed is:

1. In combination with an electrical switch having a movable contact, an operating mechanism comprising:

a drive mechansim;

a drive lever having an engaging surface and connected to said drive mechanism for rotation about an axis;

an actuating lever rotatable about said axis independent of said drive lever and having a first and a second engagement surface, said first engagement surface engageable with said engaging surface of said drive lever and said actuating lever being rotated when said engaging surface of said drive lever engages and pushes said first engagement surface of said actuating lever;

an energy storing means connected in an over-center relationship to said actuating lever for selectively storing and releasing energy for opening and closing the electrical switch in accordance with the rotational movement of said actuating lever;

a driven lever rotatable about said axis independent of said drive lever and said actuating lever and having an engagement surface engageable with said second engagement surface of said actuating lever, said driven lever being connected to the movable contact of the electrical switch for opening and closing the contact in accordance with the rotational movement of said driven lever, said driven lever being rotated when said actuating lever rotates and said second engagement surface of said actuating lever pushes said engagement surface of said driven lever; and a single common shaft for mounting thereon said drive lever, said actuating lever, and said driven lever.

2. The combination as claimed in claim 1 wherein said common shaft is rotatably supported by a frame, said driven lever is secured to said common shaft, and said drive lever and said actuating lever are rotatable relative to said common shaft.

3. The combination as claimed in claim 1 wherein said first and second engagement surfaces of said actuating lever are formed by projections disposed on said actuating lever.

4. A device comprising:

a drive mechanism;

a drive lever having an engaging surface and connected to said drive mechanism for rotation about an axis;

an actuating lever rotatable about said axis independent of said drive lever and having a first and a second engagement surface, said first engagement surface engageable with said engaging surface of said drive lever and said actuating lever being rotated when said engaging surface of said drive lever engages and pushes said first engagement surface of said actuating lever;

an energy storing means connected in an over-center relationship to said actuating lever for selectively storing and releasing energy in accordance with the rotational movement of said actuating lever;

a driven lever rotatable about said axis independent of said drive lever and said actuating lever and having an engagement surface engageable with said second engagement surface of said actuating lever, said driven lever being rotated when said actuating lever rotates and said second engagement surface of said actuating lever pushes said engagement surface of said driven lever; and a single common shaft for mounting thereon said drive lever, said actuating lever, and said driven lever.

* * * * *